US007062822B2

(12) United States Patent
Folkmar

(10) Patent No.: US 7,062,822 B2
(45) Date of Patent: Jun. 20, 2006

(54) TUBE CLIP

(76) Inventor: Jan Folkmar, P.O. Box 263, Weggis (CH) CH6353

( * ) Notice: Subject to any disclaimer, the term of this patent is extended or adjusted under 35 U.S.C. 154(b) by 0 days.

(21) Appl. No.: 10/462,055

(22) Filed: Jun. 16, 2003

(65) Prior Publication Data

US 2004/0250385 A1 Dec. 16, 2004

(51) Int. Cl.
*F16K 7/00* (2006.01)

(52) U.S. Cl. ..... 24/30.5 R; 24/543

(58) Field of Classification Search ..... 24/30.5 R, 24/505, 506, 517, 542–544, 518; 251/9, 251/10

See application file for complete search history.

(56) References Cited

U.S. PATENT DOCUMENTS 3,171,184 A * 3/1965 Posse ..... 606/120
3,461,876 A * 8/1969 Miller, Jr. ..... 606/120
4,346,869 A * 8/1982 MacNeill ..... 251/10
4,656,697 A * 4/1987 Naslund ..... 24/30.5 P
4,726,372 A * 2/1988 Perlin ..... 606/158
4,738,007 A * 4/1988 Demarest, Jr. ..... 24/67.9
4,847,956 A * 7/1989 Levine ..... 24/30.5 R
5,604,959 A * 2/1997 Bowen ..... 24/30.5 R
6,234,448 B1 * 5/2001 Porat ..... 251/10
6,644,618 B1 * 11/2003 Balbo ..... 251/10

* cited by examiner

*Primary Examiner*—James R. Brittain

(57) ABSTRACT

A clip comprising a pair of jaws each having an axially extending pressure surface, and resilient hinge arms hinged together from which the jaws are cantilevered for movement between a closed position in which the pressure surfaces are in facing opposition and an open position, and latch means for retaining the jaws closed. When the jaws are moved towards their closed position with a suitably thick object disposed therebetween, they will initially contact the object at a point and then rotate about that point, causing the hinge arms to stretch and thereby increase the spacing between the pressure surfaces, whereby they may be closed with a strong and relatively uniform clamping pressure about the object.

12 Claims, 1 Drawing Sheet

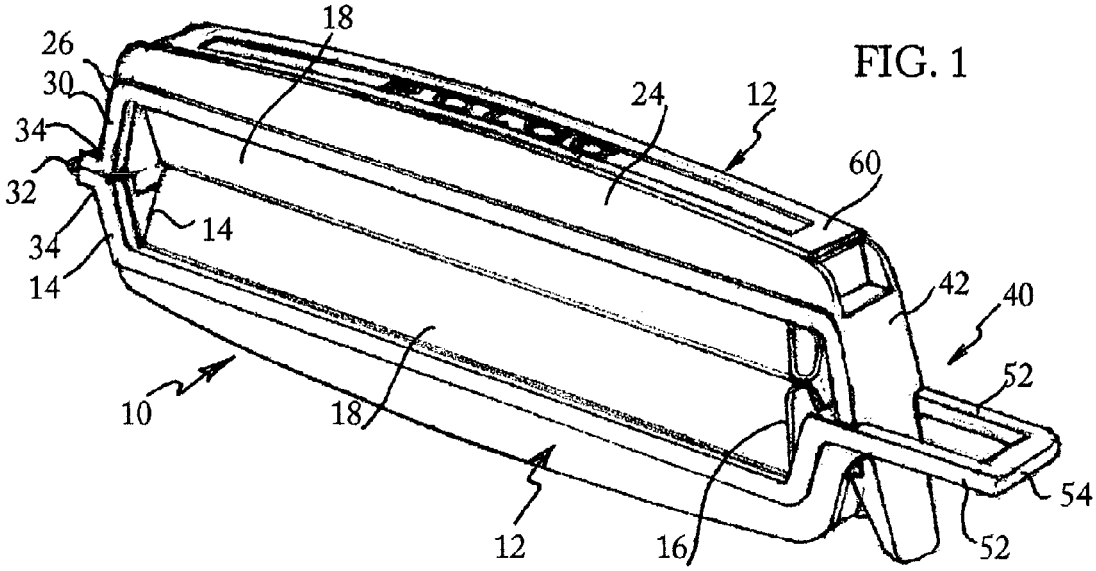
FIG. 1
FIG 2
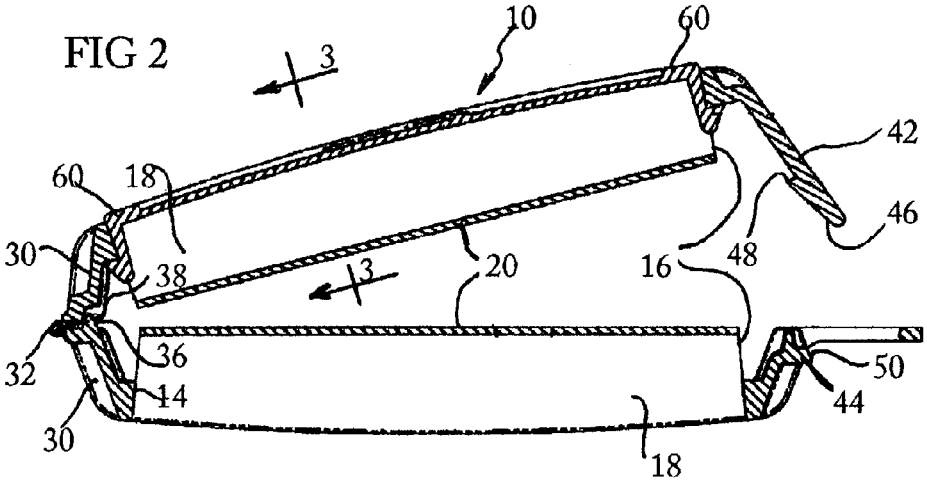
FIG 3
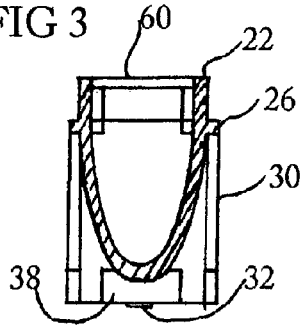
FIG 4
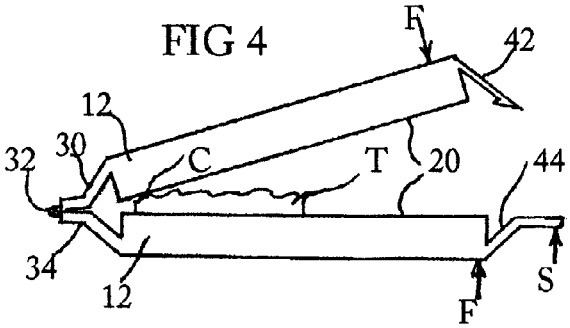

TUBE CLIP

FIELD OF INVENTION

This invention relates to clips that may find use for applying a pressure to articles about which they are clamped. It is particularly described in relation to a tube clip, having a use for expressing material from a collapsible tube. The clip of the invention is not necessarily limited to such use, however.

BACKGROUND OF INVENTION

In order to be effective, a tube clip must exert a substantial and relatively uniform pressure across the, whole of the width of the tube, it must also permit the clip to be drawn along the tube without unlatching the clip or without releasing the pressure; and it must also be relatively inexpensive to produce.

Inexpensive clips of various types are known in commerce, and typically they will comprise a pair of jaws, hinge means connecting the jaws for rotation, and a latch means for retaining,the jaws closed about an article. Clips of one type serve to close the wall of a thin film plastic bag. If it were attempted to close this type of clip about a tube, which will commonly have a wall thickness of some 10 to 20 times or more than that of a typical plastic bag, when the jaws initially contact the tube, the jaws will still be open at an appreciable angle. Should a force be applied in an effort to close the jaws, this will be expended by a substantial and unintended deformation of the jaws and the hinge structure to the point of breakage. Inexpensive clips of a second type include a spring means to bias the jaws shut. It is known to use a plastic spring means for this purpose, which may be integrally formed with the jaws of the clip. However, the pressures generated in such clips are relatively small, and unsuited for the present purposes. Moreover, these springs are pre-stressed under tension, and if it were attempted to pre-stress a simple plastic spring of the type which might find use in the manufacture of a simple and inexpensive clip, so as to provide a relatively high closure force suited for use in a tube clip, the spring tension would undoubtedly be reduced over a period of time due to plastic creep.

It is an object of this invention to provide a tube clip that is economic and effective for the desired purpose.

It is another object of this invention to provide a tube clip that may be moulded from plastic material, and that may be formed as a single, unitary piece.

It is yet another object of this invention to provide a tube clip of the foregoing nature that, while it utilizes a plastic spring means, will remain effective over a long period of time.

SUMMARY OF THE INVENTION

In accordance with a broad aspect of this invention, a tube clip comprises a pair of jaws that are adapted to be relatively stiff, so as to resist bending and twisting along their length. The jaws extend in an axial direction between opposed ends, which, for the purpose of this description may be arbitrarily defied as the forward and rearward ends. Each of the jaws has a pressure surface extending between the ends, which is intended to contact a tube when disposed between the jaws. A pair of similar, elastically resilient spring arms are rooted to the respective jaws at the rearward end, and cantilevered rearwardly therefrom. A hinge element, which may suitably and expediently comprise a live hinge, connects the distal ends of the spring arms, so as to permit the free rotation of the jaws between a closed position wherein the pressure surfaces are proximate and aligned one to the other, and an open position.

Considering the operation of the tube clip as thus far described, and assuming for the sake of convenience of description that one jaw is fixed in position, if a tube having a wall of moderate thickness is placed on the fixed jaw, and the other jaw is rotated towards its closed position, the rotating jaw will come into contact with the tube when it still subtends an appreciable angle to the fixed jaw. If a suitable force is applied to the rotatable jaw at the forward end, it will cause the jaw to rotate about the tube contact point. Accordingly, the jaw will function as a lever arm, through which a stress will be transmitted to the spring arms, causing them to undergo an elastic deformation. Such deformation may include, for example, a stretching of the spring arms and, where the spring arm includes an elbow or other non-linear portion as is preferable, a straightening of the spring arm, causing it to lengthen. The cumulative effect of these elastic deformations permits the jaws to move apart at the hinge end, and the continued application of a closing force to the rotating jaw will result in its ultimate movement to a closed position, in more or less uniform contact with the tube across the whole of its width. The tube clip will include means for retaining the jaws closed, which may suitably comprise a latching means as is generally known in the art, although this may be particularly adapted to assist in generating a clamping force on the tube, as will be described subsequently in regard to the preferred embodiment of the invention.

Given that the mating surfaces of a typical latch structure in an inexpensive clip are somewhat limited in their axial dimension, it will be appreciated that the change in geometry of the spring arms as they undergo deformation should not engender any appreciable relative axial movement of the jaws, so as to retain the register of the mating latch surfaces. Accordingly, the spring arms should be substantially identical in their structure and in their geometric arrangement. This does not preclude small differences, however, and one difference of note, where a live hinge is provided, is the provision in the spring arms of interlocking structure to retain the spring arms in transverse alignment when the clip is subject to strong transverse forces, which might otherwise cause the jaws to skew.

Having described the broad aspects of the invention, it will be further described in relation to the preferred embodiment thereof, illustrated in the accompanying drawings, from which other aims, objects, aspects and advantages of the invention will become apparent.

BRIEF DESCRIPTION OF THE DRAWINGS

In the drawings:

FIG. 1 shows inn closed position the tube clip of the invention in perspective view from the top forward end;

FIG. 2 shows the clip of FIG. 1 in open position, in medial axial cross section;

FIG. 3 is a transverse cross section along the line 3—3 of FIG. 2 and, FIG. 4 is a schematic view, not to scale, showing the clip in side elevation with a tube positioned for closure of the jaws thereabout.

DESCRIPTION OF THE PREFERRED EMBODIMENT

Considering the drawings in detail, a tube clip in accordance with the invention is identified generally therein by the numeral 10. Clip 10 comprises a pair of jaws 12 having axially opposed ends 14, 16 that are arbitrarily designated as rearward and forward ends respectively. Jaws 12 are hollow and U shaped in cross section, formed by opposed sidewalls 18, a bight 20, which is subsequently as pressure surface 20, and an upper bounding edge 22. Sidewalls 18 are somewhat convergent, to resist deformation under laterally experienced forces; they are also relatively deep, so as to increase their stiffness and resistance to bending The stiffness of jaws 12 is still further increased by increasing the depth of walls 18 progressively toward mid portions, 24 of jaws 12, whereby bounding edge 22 assumes an arched configuration. A reinforcing rib 26 which extends along jaws 12 intermediate pressure surface 20 and upper edge 22 also serves to increase the stiffness and reduce torsional deformation of jaws 12 under the influence of the forces to which it is subject.

Clip 10 further comprises a pair of spring arms 30 which root to the rearward end 14 of jaws 12, and which are cantilevered rearwardly therefrom in convergent relationship. Spring arms 30 are united at their distal end by a living hinge 32 to permit jaws 12 to rotate freely between a closed position, wherein the pressure surface 20 of one jaw is proximate and opposed to that of the other jaw of clip 10. Spring arms 30 include an elbow portion 34, and are provided with an interlock comprising tab 36 that is upstanding from the forwardly facing surface of one of the arms and a mating recess 38 formed in the other of the arms. Other than in the matter of the interlock, the clip is symmetrical in the jaw and spring arm portions thereof.

Clip 10 further includes a latch 40 disposed at the forward axial end 16 of jaws 12. Latch 40 comprises a pair of spring arms 42, 44, which root to end 16 and which are cantilevered forwardly in convergent relationship. Spring arm 42 is relatively flexible, and carries on its rearwardly directed face a ramp surface 46 and a latching shoulder 48. Spring arm 44 is relatively stiff and similar in this respect to spring arms 30, and carried a forward facing latching shoulder 50 which will be snap engaged by shoulder 48 to latch the jaws 12 of clip 10 closed. Spring arm 44 includes a pair of fingers 52 that are disposed on transversely opposed sides of latching shoulder 50 to project forwardly therefrom. A bight 54 unites the distal ends of fingers 52. Fingers 52 serve to limit the relative transverse movement of spring arm 42 and 44 when clip 10 is closed and subject to transversely applied forces that might otherwise serve to disengage latch 40. Clip 10 may optionally include a decorative cover 60 that snaps fits between walls 18.

The operation of clip 10 may be best understood with reference to FIG. 4. Considering the lower of jaws 12 to be stationary, and a tube T to be disposed between the jaws, the upper jaw 12 may be freely rotated about hinge 32 until such time as it comes into abutment with tube T at contact point C. In this position, the upper jaw will subtend an appreciable angle to the lower jaw. When a sufficient force F is applied to the jaws, it will cause the upper jaw to rotate about contact point C, against reactive forces that are generated in sprig arm 30. Such forces will effectively urge the hinge point of spring, arms 30 forwardly, towards end 14, so as to increase the effective length of the spring arms, and in turn will increase the spacing between the opposed pressure surfaces 20 of the jaws to permit the accommodation of tube T. It may be noted here that while jaws 12 are structured to be relatively stiff, a certain degree of resilience may be tolerated and is even desirable, so as to permit a slight arching of the jaws during such time as the force F is applied, thereby facilitating the engagement of latching surfaces 48, 50 of latch 40. The arching of jaws 12 in this manner will induce a tensile stress in the jaws, which will tend to be transferred to spring arms 30, 42 and 44 upon release of the applied force F. The application of a supplemental force S to fingers 52 will serve to urge spring arm 44 inwardly, and so increase the effective length of that spring arm, may also facilitate the engagement of latch 40.

When latching shoulders 48, 50 are engaged and the closing forces F and S are removed from clip 10, the tensile forces in spring arms 30, 42 and 44 will equalize and jaws 12 will clamp firmly onto tube T across the whole of its width, thereby acting to squeeze any material contained in tube T forwardly as clip 10 is drawn forwardly, in relation to the tube.

It will be understood that the clip 10 of the preferred embodiment is particularly amenable to being manufactured as a unitary moulding from a thermoplastic material, other than in the provision of the optional, decorative cover 60. While this is expedient and may be preferred particularly where cost is a prime factor, it will be appreciated the clips of the invention may be manufactured in whole or in part from other materials including, for example, spring steel and/or stainless steel.

The invention claimed is:

1. A clip comprising in combination first and second jaws each extending in an axial direction between opposed ends, said jaws being structured to be relatively stiff;

said jaws each having a pressure surface extending between said ends for contacting and applying a pressure to an article disposed therebetween;

jaw mounting means comprising a pair of similar, elastically resilient spring arms rooted to respective ones of said jaws at one said end and cantilevered therefrom, and a hinge element interconnecting said spring arms at the distal end thereof;

wherein said spring arms extend convergently from said jaws towards said hinge element;

said mounting means permitting the free rotation of said jaws about said hinge element between a first, closed position wherein said jaws are in opposition and spaced apart by a predetermined distance, and further permitting the pivoting action of said jaws under the influence of a closing force applied thereto remote from said mounting means, about an article having a thickness greater than said predetermined dimension when disposed therebetween, which serves to induce a tension in said spring arms and concomitantly to increase the spacing between said pressure surfaces; and means for retaining said jaws closed about said article with said spring arms under said induced tension, to thereby clamp said article between said jaws.

2. A clip as defined in claim 1 wherein said retaining means is a latch means.

3. A clip as defined in claim 2 wherein said latch means comprises a pair of spring arms rooted to the ends of respective ones of said jaws opposed to said mounting means.

4. A clip as defined in claim 3 wherein said jaws have a reinforcing rib extending therealong.

5. A clip as defined in claim 2 wherein said mounting means and said latch means each include cooperating means to restrict the relative lateral movement of said jaws.

6. A clip as defined in claim 1 wherein said spring arms include a non-linear portion.

7. A clip as defined in claim 6 wherein said non-linear portion is an elbow.

8. A clip as defined in claim 1 wherein said jaws have a hollow U-shaped cross section.

9. A clip as defined in claim 1 wherein said hinge element is a living hinge.

10. A clip as defined in claim 1 wherein there is a substantial symmetry at least in said mounting means.

11. A clip as defined in claim 1 formed as a thermo-plastic moulding.

12. A clip as defined in claim 1 formed as a one piece thermo-plastic moulding.

* * * * *